United States Patent [19]

Allen

[11] 4,257,650

[45] Mar. 24, 1981

[54] METHOD FOR RECOVERING SUBSURFACE EARTH SUBSTANCES

[75] Inventor: Joseph C. Allen, Bellaire, Tex.

[73] Assignee: Barber Heavy Oil Process, Inc., Houston, Tex.

[21] Appl. No.: 940,390

[22] Filed: Sep. 7, 1978

[51] Int. Cl.[3] ..... E21B 43/24; E21C 41/10

[52] U.S. Cl. ..... 299/2; 166/50; 166/245; 166/263; 166/303

[58] Field of Search ..... 166/245, 263, 272, 302, 166/303, 50, 57, 62; 299/2, 3, 4, 5, 6

[56] References Cited

U.S. PATENT DOCUMENTS

| | | | |
|---|---|---|---|
| 1,520,737 | 12/1924 | Wright | 166/68 X |
| 2,365,591 | 12/1944 | Ranney | 166/272 X |
| 3,259,186 | 7/1966 | Dietz | 166/263 |
| 3,333,637 | 8/1967 | Prats | 166/303 |
| 3,353,602 | 11/1967 | Geertsma | 166/303 |
| 3,455,392 | 7/1969 | Prats | 166/303 |
| 3,530,939 | 9/1970 | Turner et al. | 166/303 |
| 3,882,941 | 5/1975 | Pelofsky | 166/303 |
| 3,948,323 | 4/1976 | Sperry et al. | 166/303 |
| 4,085,803 | 4/1978 | Butler | 166/303 |
| 4,099,570 | 7/1978 | Vandergrift | 166/303 |
| 4,099,783 | 7/1978 | Verty et al. | 166/272 X |
| 4,160,481 | 7/1979 | Turk et al. | 166/272 |

OTHER PUBLICATIONS

Ranney, "The First Horizontal Oil Well", *The Petroleum Engineer,* Jun. 1939, pp. 25–30.

*Primary Examiner*—Stephen J. Novosad
*Assistant Examiner*—George A. Suchfield
*Attorney, Agent, or Firm*—Bard & Groves

[57] ABSTRACT

This invention relates to methods and systems for recovering high viscosity oils, petroleum substances and other minerals from subsurface earth formations. In particular, one or more large diameter shaft holes are provided which preferably terminate in an enlarged subterranean chamber. A plurality of drill holes are provided, with perforated piping which extend radially from the chamber into the formation, and from which oil and the like may be recovered. It is a particular feature of this invention to provide means and methods for injecting a mixture of steam and a noncondensable gas into the drill holes, whereby the driving mechanism of the formation may be selectively maintained or enhanced at the same time the viscosity of the oil in the formation is reduced.

9 Claims, 9 Drawing Figures

FIG. 1
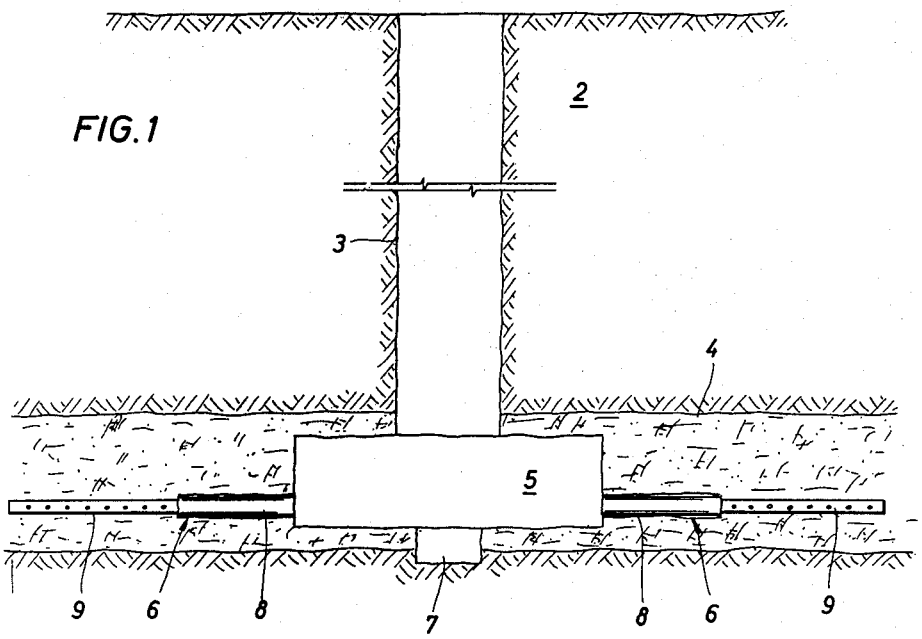
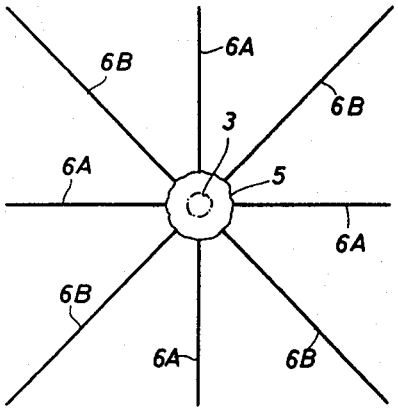
FIG. 2
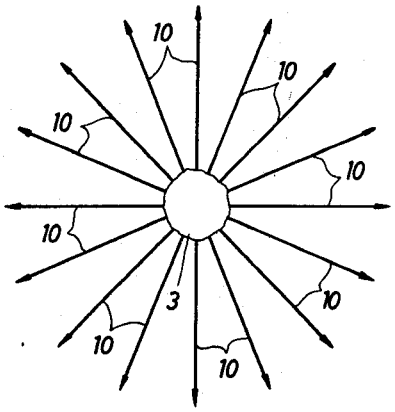
FIG. 4

FIG. 3
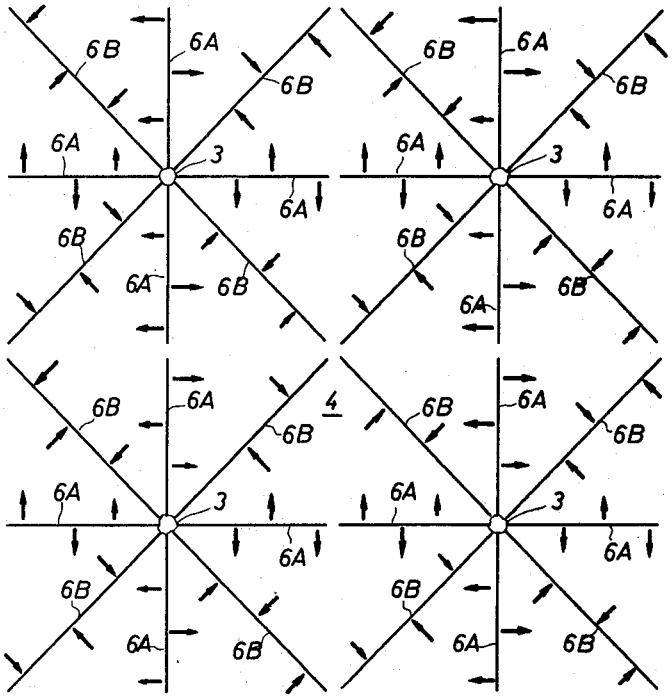
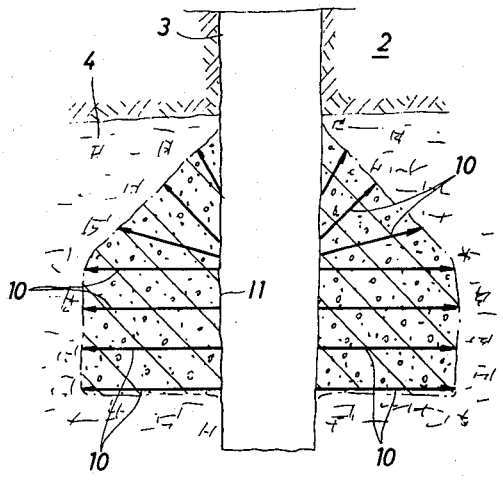
FIG. 5
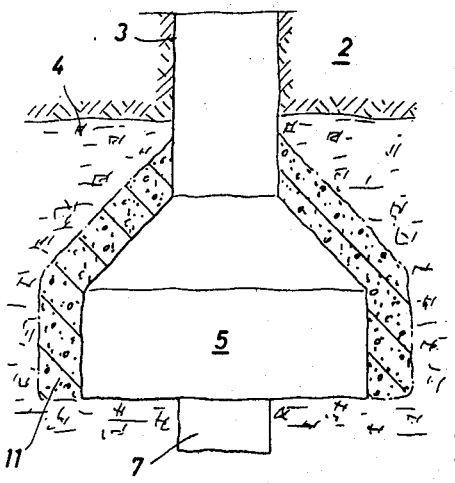
FIG. 6

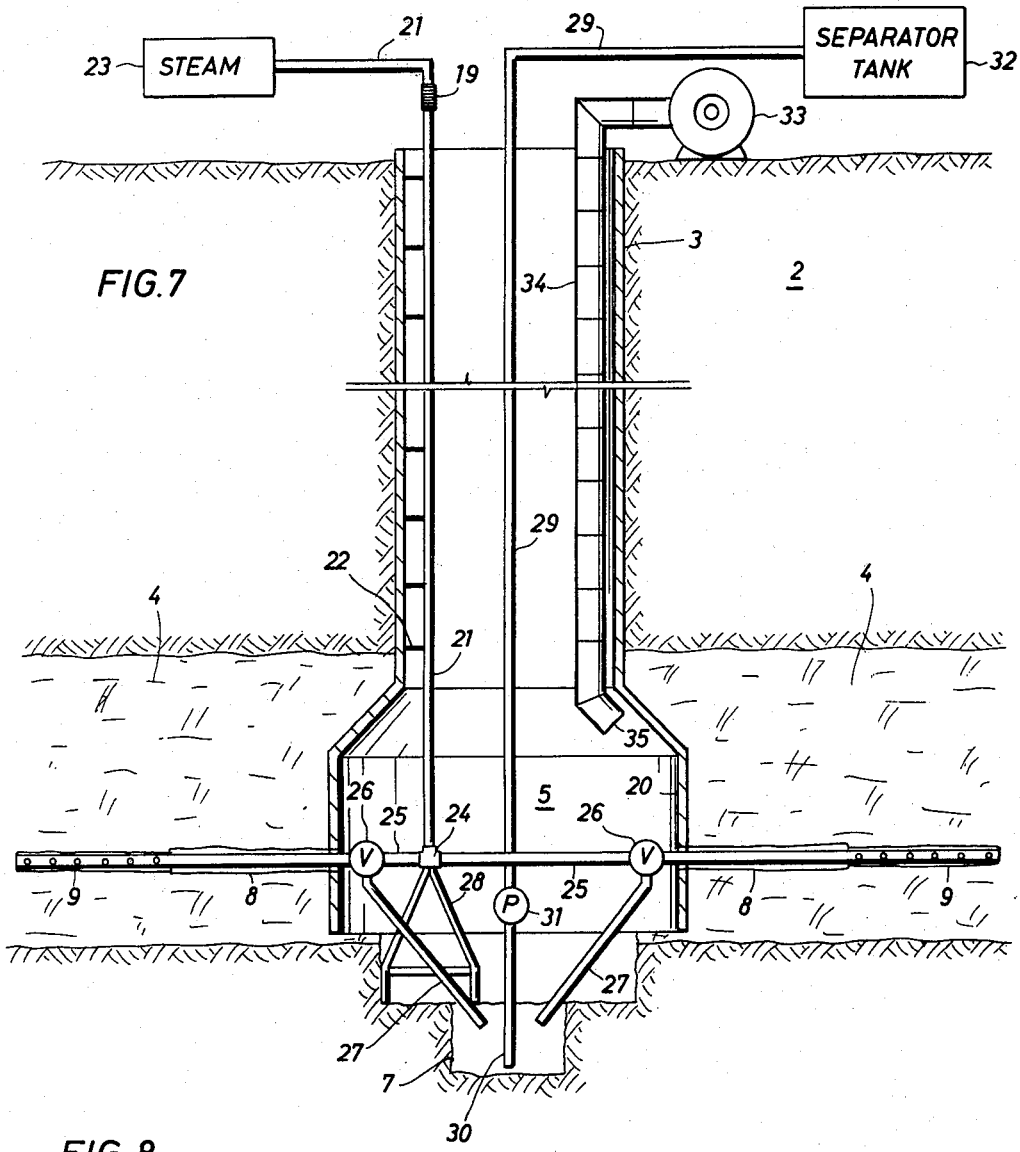
FIG. 7
FIG. 8
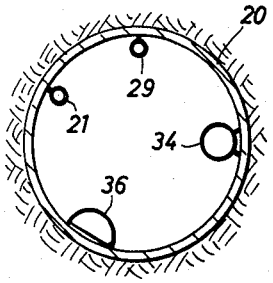
FIG. 9
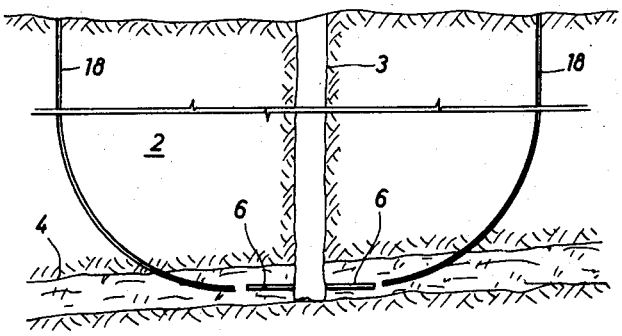

METHOD FOR RECOVERING SUBSURFACE EARTH SUBSTANCES

BACKGROUND OF THE INVENTION

This invention relates to methods for recovering minerals from subsurface earth formations, and more particularly relates to improved methods for recovering high viscosity oil.

It is well known to pump steam into a vertical borehole and laterally into the formation in order to heat the oil in the formation to render it less viscous and in order to produce a driving force to move the oil to other recovery wells. It has been found in such steam flood operations that the driving force provided by the steam will collapse when the temperatures in the formation fall below the boiling point of water. In order to avoid this driving force collapse, inert or noncondensable gases have been added to the steam in order to enhance and maintain an oil-driving force within the formation.

Steam flood techniques may also be applied to what is termed horizontal wells. In horizontal wells, laterals protrude into the formation from a mine shaft and steam is introduced into the laterals in order to provide heat to the formation for reduction of the oil viscosity and to produce a gas cap of steam which functions as a driving force to move the oil.

What is not known in the prior art and what constitutes the features and concepts of the present invention is the use of a mixture of steam and an inert gas in a horizontal well. As noted above, various attempts have been made to recover oil in a vertical well by employing a mixture of steam and an inert or noncondensable gas. For example, in U.S. Pat. No. 3,908,762, a complex steam injection process is depicted which employs a mixture of steam and a noncondensable gas and wherein significance is primarily based upon the disclosure that the noncondensable gases may include nitrogen, air, $CO_2$, flue gas, exhaust gas, methane, natural gas, and ethane.

An early disclosure relating to the horizontal well concept is provided in a paper published by Ranney in the *Petroleum Engineer* in 1939 entitled "The World's First Horizontal Hole". The article proposes the drilling of a shaft into an oil-bearing formation and then drilling radial horizontal laterals into the formation. Air, gas, or steam is disclosed as a possible fluid injection medium. However, there is no reference to the use of a mixture of steam and an inert gas as an oil recovery medium.

The above described prior art techniques, however, are each subject to disadvantages which are sought to be avoided with the method of the present invention. For example, the process depicted and described in U.S. Pat. No. 3,908,762, suffers limitations relating to critical velocity concepts to be described hereinafter, as well as limitations due to restrictions on critical injection rate. The Ranney process also suffers from limitations due to the inefficiency of the pressure medium as a driving force.

As will be hereinafter set forth, in more detail, such disadvantages are overcome by the present invention.

SUMMARY OF THE INVENTION

In an ideal embodiment of the present invention, a vertical mine shaft or the like is bored or dug from the surface to the formation of interest, whereby personnel and equipment can reach the face of the formation.

More particularly, the portion of the borehole across the formation is preferably enlarged laterally so as to provide a work chamber of a shape and size sufficient to permit operations to be conducted at the face of the formation in an appropriate manner, subject to whatever shoring may be required under particular conditions. Thereafter, drill holes are bored into the face of the formation and radially about the chamber, through which a suitable fluid is thereafter injected into the formation by way of a conduit leading to the surface.

The particular spacing and arrangement of drill holes will, of course, depend upon the size and lithology of the formation of interest, but it is a feature of the invention to provide approximately eight different radially extending drill holes for each shaft hole, and to further extend such drill holes to a location adjacent the ends of similar radials extending from an adjacent vertical shaft hole. As will hereinafter be explained in detail, each group of radial drill holes will then define a rectangular pattern within the field, and thus the field may be effectively "covered" with a blanket of such rectangular patterns. The radials themselves will usually extend in a generally horizontal direction, although it may be preferable to extend the radials along the lateral axis of the formation. Alternatively, the radials may be positioned at a slight upward angle relative to their respective shaft hole in order to accommodate gravity flow of the oil from the formation.

It is within the concept of the present invention to locate the radials adjacent the lower limit of the formation, whereby the fluid injected therefrom will also tend to rise as well as travel laterally through the formation, and also to provide additional pluralities of such radial drill holes at other higher locations within thicker formations, whereby the formation adjacent the shaft hole may be more effectively heated. Furthermore, it is within the concept of this invention to inject fluid through only a portion of the radials, while also recovering oil from one or more of the other radials extending from the same shaft hole. Thus, the minerals of interest which are relatively adjacent such shaft holes may be more effectively recovered, as well as providing better control over the pattern of sweep flow through the overall field.

As noted above, the central concept is, of course, a steam injection or flood technique wherein a mixture of steam and an inert gas (such as flue gas, air and the like) is injected into the formation, rather than steam only.

One of the major problems encountered in conventional recovery techniques in vertical wells, and in particular wherein steam only is injected into the formation, is that such techniques must take into consideration an operating factor commonly referred to as the "critical velocity" at which the fluids move through the formation matrix, in order to effectively approach or achieve the maximum volumetric sweep efficiency of the formation of interest. The way this is usually done, however, is to operate the process or technique with respect to that steam injection rate which is most nearly effective to achieve the "critical velocity" for the particular formation of interest, and which is therefore beneficial in a horizontal well in accordance with the particular installation.

If the steam is injected at a rate which is either greater or less than the "critical injection rate" for the particular formation sought to be produced, the result will be that fluids will be produced from formation at less than the production rate which can be achieved with this critical injection rate. Further, the total amount of fluids recovered may be substantially below that which is possible by achieving and maintaining steam injection at the critical rate.

The volumetric sweep efficiency of a formation is dependent upon many factors such as its porosity, the viscosity of the oil therein, and the homogeneity of the rock matrix. Accordingly, the critical injection rate of the operation will therefore also depend upon these and other factors which may vary significantly between different installations. Nevertheless, in most if not all conventional steam injection operations it is a primary objective to determine this critical injection rate, and to thereafter hold to that factor as closely as possible.

This concept of critical velocity can best be explained by visualizing a cross-section of a given formation reached by a vertical borehole. When conventional steam recovery operations are initiated, steam is injected into the formation in an attempt to heat the oil and to drive it laterally into an adjacent recovery well. A maximum volumetric sweep efficiency would exist if it were possible to permeate the steam across the entire cross-section of the formation and move the steam laterally as a front. Thus, ideally this steam front would proceed as a vertical wall from the borehole uniformly across the formation and thereby force all of the oil in the formation out ahead of it and into an adjacent recovery well. The steam in this case would be functioning akin to a piston driving away all oil lying in its path of travel.

Practically, this piston action of steam in a vertical well is not possible due to formation anomalies and the phenomena known as fingering and gravity override.

In the case of fingering, the steam ruptures the interface and penetrates into the formation without displacing any significant quantity of oil. In the case of gravity override, the steam rises directly to the top of the formation and, thereafter, passes out through the formation over or above substantially all of the oil sought to be displaced.

Fingering is accentuated by high steam injection rates which produce a plurality of laterally extending paths of steam flow that jut across the formation and into the recovery well. These finger-like steam flow paths displace very little oil and merely vent through to the recovery well as waste steam. Obviously, then, steam fingering is an undesirable result from the standpoint of heat loss and reduction of the steam driving force.

According to conventional techniques, there is always the pressing need of maintaining the injected steam at the critical injection rate to achieve maximum volumetric sweep efficiency. Low steam injection rates fail to maintain an efficient driving interface and a low volumetric sweep efficiency results. Abnormally high injection rates of steam are most likely to produce fingering.

This limitation of critical velocity is overcome in the present invention, however, because fingering is not a significant factor in a horizontal well of the type depicted herein. In particular, fingering of the steam which prevents the maximum volumetric sweep efficiency in a vertical well from being achieved may actually be beneficial to the present invention. This is for the reason that if fingering does occur in the process of this invention it merely adds to the gas cap above the formation without significantly detracting from the efficiency of the steam sweep. This is peculiar to the concept of a horizontal well, since the horizontal well benefits from a gas cap above the formation as the driving force. Thus, if fingering does occur the escaping steam builds up the overlying gas cap rather than vent to a recovery well as is the case with conventional vertical wells.

Fingering can be tolerated in a horizontal well of the type herein described. It follows, therefore, that the steam may be injected at rates far above the critical injection rate which as noted above is detrimental in conventional vertical wells.

Gravity override will always occur when the density of the injected fluid is less than that of the formation fluids, and there is at least some vertical permeability in the formation, which factors are always present in all steam injection operations. Furthermore, it is known that the addition of an inert gas to the injection fluid will accentuate this detrimental phenomenon, since the inert gas will tend to lift the driving fluid mixture within the formation, and to thereby enhance the effect of gravity override.

Because the present technique does not employ a vertical driving fluid/oil interface, gravity override of such an interface cannot occur. In fact, the natural lifting effect of the inert gas will be of benefit to the present operation.

Conventional vertical wells sought to be produced by steam injection have long suffered from another drawback of driving force collapse. More particularly, at formation temperatures below the boiling point of water, the steam condenses with the result that little driving force is available to sweep the oil from the formation. In fact, condensation of the steam driving force can create a pressure drop in the formation which, in turn, results in a reverse effect. This is occasionally sought to be overcome by the addition of an "inert" (non-condensing) gas to the steam being injected into the formation, for the purpose of preventing or mitigating the pressure collapse when the temperature of the injected mixture drops below the boiling point of water in the formation.

This has not proved to be altogether satisfactory, however, since the heat carrying capacity of the inert gases is much lower than that of steam, and therefore only very limited proportions of inert gases could be tolerated in vertical well recovery operations. Too high a proportion of inert gas to steam resulted in a driving force mixture that did not carry enough heat into the formation to reduce the viscosity of the oil in order to enhance the sweep. Also, as previously explained, the inert gas increased the chances of gravity override. Conversely, too low a proportion of inert gas to steam resulted in a driving force mixture which when the steam collapsed contained too small an amount of inert gas to function significantly as a driving force. For conventional vertical wells, the addition of inert gas to a fixed steam at the critical velocity would accentuate viscous fingering and gravity override, thereby exceeding the critical velocity, thereby reducing volumetric sweep effeciency.

Such disadvantages are not, however, inherent in the horizontal well of the present invention and the drawbacks of the prior art are avoided. In particular, the constant balancing and counterbalancing of the ratios of steam to inert gas, in conventional operations, is not required in operations employing the present invention. This is for the reason that this invention operates at injection rates far above those rates employed in conventional vertical wells. Since higher injection rates can be utilized in the present invention—even to the point of tolerating steam fingering—these higher injection rates amply supply sufficient heat to the formation even when the inert proportion is high, and amply provide sufficient driving force if and when the inert gas proportion is low.

While the prior art discloses horizontal steam injected wells, in particular Ranney referred to herinabove, it is only a casual disclosure. For example, the prior art in the field of horizontal well technology does not disclose the concept of totally disregarding the critical velocity as a factor in oil recovery. Further, horizontal well technology failed to realize the advantage disclosed herein of employing a mixture of steam and a noncondensable inert gas for oil recovery operations in a horizontal well. More is involved herein than merely substituting concepts from conventional vertical well recovery technology into the unique operation of a horizontal well, since as noted above, the two are antithetical for all practical purposes.

PREFERRED EMBODIMENT

Although the methods and apparatus of the present invention are suitable for the recovery of both inorganic and organic minerals, an embodiment of the invention is especially suitable for recovering high viscosity oil and the like. More particularly, the subject formation is penetrated by a plurality of large diameter shaft holes, as hereinbefore described, and a plurality of eight equally spaced apart drill holes are then drilled radially outwardly therefrom into the formation at distances such that the radials then define a rectangular pattern within the field.

A mixture of steam and inert gas is injected into the radials for a first discrete time interval depending upon the thickness and other lithological characteristics of the formation, and then the wells are "shut in" to trap the steam mixture in the formation during a second discrete time interval, after which the radials are again opened for a third discrete time interval to allow the oil to enter the shaft well through the radials and be pumped to the surface. This completes a single steam-soak cycle. This "soak" technique is then repeated during one or more subsequent cycles, whereby the steam and inert gas mixture not only tends to penetrate further into the formation with each injection, but wherein the oil lying within the portion of the formation being soaked is caused to be heated gradually to the temperature sought to be achieved.

After the formation has been treated sufficiently by the "soak" technique, as thus described, the steam mixture may then be injected continually into some or all of the radials extending from selected shaft holes, while the remaining radials extending from the same or other shaft holes are opened to receive oil from the formation. Thus, the steam mixture is caused to sweep into the formation and across the field, to thereby more effectively produce the oil contained therein.

In conventional steam injection processes, wherein steam is injected into the top of a perforated steel well casing, the steel casing tends to drain away substantial amounts of heat sought to be applied to the formation. Since, in this embodiment of the invention, the radial drill holes through which the steam mixture is injected lie entirely within the formation, heat loss by way of the steel casing therein is not significant since the heat merely transfers to the formation sought to be heated. On the other hand, it is desirable for the steam mixture to enter the formation at a distance from the shaft hole or chamber, so that the steam mixture will tend to move outwardly therefrom instead of bypassing back into the chamber, and so it may be preferable to provide perforations or vents only in the outer or further portions of the casing within the radial drill holes. Furthermore, it may be preferable to insert pre-perforated pipe or casing into the radial drill holes, rather than to perforate the casing in a conventional manner after it has been inserted.

In another feature of the present invention, it should be noted that the sweep pattern or configuration of the steam mixture injected into the field is a function of the location and spacing of both the shaft holes and the radial drill holes. In addition, the size, spacing and position of the perforations in the pipe or casing inserted in these lateral drill holes will also determine the pattern or configuration of the steam mixture sweep in the formation.

A particular feature of the present invention is that the steam mixture is not only injected directly into the formation without heat loss through the conventional well casing, but that the heat emanating from the injected steam mixture is more effectively transferred to the oil within the formation. Accordingly, the effectiveness of the present invention is less dependent upon the permeability and other lithological characteristics of the formation than is the case with the methods of the prior art.

Another feature of the present invention is that the drill holes radially extending from the shaft holes may be selectively sized and positioned so as to more effectively sweep the formation with the steam mixture during the flood sequence than is the case with the methods and practices of the prior art, and whereby production of this type of oil is maximized.

Thus, a particular advantage of this invention is its use as an in situ process for reducing the viscosity of so-called "heavy" oil in subsurface earth formations, whereby such oil may be recovered. It is admittedly old to inject steam into an oil-bearing formation to reduce the viscosity of such oil. Furthermore, it is admittedly old to drill a large-diameter mine shaft into an oil-bearing formation and to thereafter recover such oil through a plurality of drill holes extending radially outward from the mine shaft into the formation. Finally, it is admittedly old to inject steam into such an array of lateral drill holes, but using conventional steam injection techniques and for conventional purposes only.

In the present invention, the process is not merely injection of steam and inert gas into lateral drill holes extending radially into the formation from a mine shaft and the like but to employ a sequence of alternate "injection" and "soak" intervals for the purpose of trapping an increasing amount of heat and pressure within an expanding areal portion of the formation. When the technique is practiced in the proper manner as explained in the instant patent application, the oil or bitumen or the like is not only rendered less viscous to an increasing degree, the treated oil is then caused to be moved through the formation to a selected borehole or collection point by the increased formation pressure also being developed.

As will be apparent from a full understanding of the present invention, this simultaneous reduction in viscosity and increase in formation pressure is not to be achieved effectively using conventional steam injection techniques. In the first place, it is important that the steam and inert gas be injected effectively into and throughout a substantial areal portion of the formation, and this is substantially impossible without the use of the type of laterally extending drill or boreholes which are positioned as radials from a mine shaft or the like. In the second place, however, it is desirable to hold the formation under pressure during appropriate intervals to let the heat from the steam and inert gas mixture permeate through an increasing portion of the formation.

In other words, to effectively use this process, the steam-inert gas may be injected into the formation during a limited or discrete "injection" interval to achieve a pre-selected pressure within the formation, and that each such injection interval or cycle may be followed by a "soak" cycle during which the steam and inert gas then in the formation is trapped to cause the formation to be literally soaked with heat. The process contemplates a repetitive series of such cycles, of course, not only to gradually effect permeation of a large portion of the formation with enough heat to reduce the viscosity of a substantial amount of oil, but also to move such oil through the formation to the collection point or well.

As noted above, prior art techniques are subject to many disadvantages. In the case of conventional vertical wells using steam injection to recover high viscosity oil and the like, it should be noted that the formation is contacted by steam only at the interface between the formation and the borehole, and this tends to restrict the input rate of steam laterally into the formation. Even more serious, conventinal vertical well steam injection techniques often require as many as ten or more injector wells for each twenty-five acres of area, and heat losses by way of the steel well casings are accordingly substantial. In addition, steam injected into the formation through a conventional vertical borehole will often override the oil in the formation and travel directly to the producing wells. Even more particularly, when the temperature of the steam drops below the boiling point of water, the resulting condensation of the steam into minute droplets of water tends to produce a collapse of the driving force sought to be applied to the oil in the formation.

If the formation is injected with heated noncondensable gases such as hydrogen, nitrogen, etc., this driving force will continue to be exerted regardless of the particular temperature of the injection gas. However, noncondensable gases have a relatively low heat capacity, and therefore do not transmit heat to the formation as effectively as steam. Moreover, there is an even greater tendency for noncondensable gas to rise to the top of the formation, and to accordingly by-pass the oil therein, especially when the formation contains a fissure or other internal discontinuity.

Recently, an improved steam injection technique has been disclosed which is described in U.S. patent application Ser. No. 766,523, which was filed Feb. 7, 1977 now U.S. Pat. No. 4,160,481, by L. Jan Turk and Ralph D. Kehle, and which overcomes or alleviates certain of the more troublesome disadvantages of the prior art. In particular, this new technique disclosed the use of a large diameter shaft hole in lieu of the conventional drill hole, with an enlarged work chamber located at the bottom of the shaft hole and adjacent the face of the formation of interest. More particularly, drill holes are then bored into the face of the formation so as to extend as radii from the work chamber and laterally into the formation, whereby steam injected into these laterally radiating drill holes will more effectively and deeply permeate the formation of interest. In addition, this new steam injection technique contemplates that steam will initially be injected during a discrete "injection" cycle, whereupon the radial drill holes will be stoppered to trap the injected steam within the formation for a further "soak" cycle of discrete duration before production from the formation is attempted.

As hereinbefore stated, this new Turk et al technique, which may be repeated for successive "injection" and "soak" cycles before production is attempted, will be seen to have significant advantages over the prior art. In particular, heat loss by way of the well casing is substantially eliminated since the injection wells lie entirely within the formation of interest. Furthermore, steam injection with this technique achieves much greater volumetric sweep efficiency since the radial drill holes can be located at the bottom edge of the formation, and since they tend to introduce steam into the formation at points deep within the formation itself. On the other hand, steam injected by this new process will nevertheless condense when its temperature drops to the boiling point of water, which generates a collapse of driving pressure within the formation. Furthermore, this particular phenomenon is especially troublesome in view of the fact that an objective of the "soak" cycle is to enhance formation pressure as well as to heat the oil trapped therein.

It is a particular feature of the present invention to recover oil from the same drill hole or holes which are used for injecting the heating mixture into the formation. What is of special significance, however, is that the driving mechanism for the oil is the pressure induced into the formation by the injected heating fluid, rather than gravity flow as may heretofore have been expected.

The primary if not sole purpose of injecting steam into the formation, in any steam-injection operation, is to effect heat transfer into the oil in the formation, and is only secondarily to enhance the pressure in the formation. This is because steam will hold more heat than any of the inert gases contemplated for this invention. On the other hand, the primary purpose of injecting an inert or non-condensible gas into the formation is to enhance formation pressure, and is only secondarily to effect heat transfer into the oil.

Accordingly, it is a particular feature of the present invention to inject a substantial quantity of inert or non-condensible gas into the formation, either simultaneously with injection of steam, or in conjunction with separate injection of steam according to a preselected sequence. For example, the "soak" cycle of the operation may comprise injection of a heating fluid which may be predominately or entirely composed of steam, followed by a discrete shut-in period during which the injected fluid is trapped in formation. Thereafter, the process may conveniently include an additional step wherein the formation pressure is enhanced by injection of an additional fluid which may be predominately or entirely composed of a non-condensible gas, before the injection boreholes are again opened to provide for recovery of oil from the formation.

This particular sequence, wherein the "soak" cycle is followed by a "pressuring" cycle, before recovery is attempted, may even be repeated one or more times before the wells are opened for production. Alternatively, the injection fluid used to heat the oil, or even to pressure the formation, may conveniently include a solvent and/or other materials such as a surfactant and the like.

For these reasons, it is a feature of the present invention to provide a novel method of recovering oil and the like from subsurface earth formations, comprising the steps of drilling a borehole substantially laterally into said subsurface earth formation, injecting a heating fluid comprising steam into said borehole during a first discrete time interval for transferring heat to oil in said formation, thereafter injecting a pressurizing fluid into said borehole during a second discrete time interval for creating a pressure on said oil in said formation, and withdrawing oil from said borehole in response to said pressure created in said formation during a third time interval following said first and second intervals.

It is another feature of the present invention to provide an improved method of recovering oil and the like from a subsurface earth formation, comprising the steps of establishing a shaft hole extending from the surface of the earth to a formation of interest and having a cross-sectional size accommodating passage of personnel therethrough, enlarging said shaft hole laterally within said formation to establish an operating chamber connecting said shaft hole with said formation, drilling a plurality of boreholes radially extending from said chamber into said formation, injecting a fluid mixture of steam and an inert gas through at least one of said boreholes and into said formation, and thereafter withdrawing said mineral from said formation.

These and other features and advantages of the present invention will become apparent from the following detailed description, wherein reference is made to the figures in the accompanying drawings.

IN THE DRAWINGS

FIG. 1 is a simplified pictorial representation partly in cross section of a portion of an exemplary installation for recovering oil from a subsurface earth formation according to the concepts of the present invention.

FIG. 2 is another different functional representation of the installation suggested in FIG. 1.

FIG. 3 is a simplified functional representation of the overall installation suggested in FIGS. 1 and 2.

FIG. 4 is a simplified functional representation of a stage in the construction of the installation suggested in FIGS. 1–3.

FIG. 5 is another simplified functional representation of another stage in the construction of the installation suggested in FIGS. 1–3.

FIG. 6 is a further different functional representation of a third stage in the construction of the installation suggested in FIGS. 1–3.

FIG. 7 is a more detailed pictorial representation, partly in cross section, of certain mechanical features of the installation suggested in FIGS. 1–3.

FIG. 8 is another view of the installation sought to be depicted in FIG. 7.

FIG. 9 is another simplified functional representation of an alternative installation embodying the concepts of the present invention.

DETAILED DESCRIPTION

Referring now to FIG. 1, there may be seen a simplified pictorial representation of one type of system embodying the concepts of the present invention for recovering heavy oil and the like from a subsurface earth formation, and depicting a substantially vertical mine shaft 3 or the like drilled from the surface of the earth 2 to and into a subsurface earth formation 4 of interest. More particularly, it may be seen that the shaft 3 is drilled completely through the formation 4, and is thereafter excavated laterally within the formation to provide a work chamber 5 with a sump hole 7 in the floor of the chamber 5 immediately below the lower end of the shaft 3. As may be seen in FIGS. 1 and 2, the radial lines 6 are thereafter drilled into the earth formation 4 from the wall of the chamber 5, preferably at or adjacent the lower limits of the formation 4.

Referring again to FIG. 1, it may be seen that the portion of the radials 6 extending from the wall of the chamber 5 may be suitably provided with so-called "surface" casing 8, with the outer end of the casing 8 thereafter provided with pre-perforated drain line pipe 9. The walls of the shaft 3 may be conveniently sealed with sections of bolted or welded steel plates to form the casing 20, as hereinafter depicted in FIG. 7, or it may be lined with an appropriate material such as Gunite, to prevent caving or other collapse of the walls of the shaft 3. The diameter of shaft 3 is preferably of a size sufficient to accommodate the passage of men and equipment from the surface of the earth 2 to the interior of the work chamber 5. Accordingly, the shaft 3 may be constructed by various conventional means, such as by drilling with a large diameter auger (not depicted), or by conventional excavation, depending upon the character of the various strata of the earth 2 lying above the formation 4 of interest.

Referring now to FIG. 7, there may be seen a more detailed pictorial representation of the installation functionally represented in FIG. 1, and showing that the shaft 3 has been underreamed or enlarged to provide the chamber 5, and then has been provided with a steel liner 20 throughout the length of the shaft 3 and the walls of chamber 5. More particularly, surface equipment is represented as including a source of live steam 23 or other heating means such as a mixture of steam and an inert gas explained more fully hereinafter, and having its discharge line 25 extending down to the chamber 5 to a junction 24 having lateral lines 25 interconnected with each radial 6 by means of a two-way control valve 26. The line 21 may conveniently be supported in the shaft 3 by means of a plurality of brackets 22 interconnecting the lines 21 to appropriate locations along the length of the steel line 20, and the assembly composed of the line 21 and junction 24 may be further supported within the chamber 5 by a suitable support assembly 28 positioned on the floor of the chamber 5.

Referring again to FIG. 7, it may be seen that the installation also includes an oil collection line 29 having its lower intake portion 30 positioned at or adjacent the bottom of the sump 7, and having its upper end running to the surface of the earth 2 for interconnection with a conventional separator tank 32, with the usual assembly of tank batteries and other apparatus not specifically depicted in FIG. 7. As will hereinafter be explained in detail, oil is intended to be accumulated in the sump 7, and thus the collection line 29 is preferably provided with a suitable pump 31 for lifting oil from the sump 7 through the collection line 29 to the separator 32 and other surface equipment.

Referring again to FIG. 7, it will be apparent that if personnel are expected to operate within the chamber 5 for any extended period of time, ventilation of the interior of the chamber 5 is required. Accordingly, an air line 34 is preferably extended down through the shaft 3, with its upper end connected to an appropriate blower 33 at the surface, and with its lower discharge vent 35 appropriately positioned within the chamber 5. In addition, a caged or shield ladder 36 or other suitable means may be included to permit workmen to enter and depart from the chamber 5.

It will be apparent that both the oil collection line 29 and the air line or duct 34 must also be supported within the shaft 3. Accordingly, and as more particularly suggested in FIG. 8, it will be seen that the oil line and air duct 34 may also be connected to the steel liner 20 by appropriate brackets in the same or substantially the same manner as hereinbefore stated with respect to the line 21.

Referring again to FIG. 7, it may be seen that the installation depicted therein is arranged primarily to inject a steam mixture from its supply 23 through the line 21 to and into each conductor casing 8 and drain line 9 within the formation 4. Such injection may be continued for a preselected length of time such as three to four weeks. After the steam mixture injection has been terminated, the entire areal portion of the formation 4 will preferably be allowed to "soak" for an additional period, such as a week, during which the heated oil within the formation 4 should experience further reduction of its viscosity. Thereafter, the valve 26 for each radial line 6 is changed to its alternate position, whereby the steam mixture from the line 21 is interrupted, and wherein oil from the formation 4 may then drain into the perforated drain lines 9, and through the conductor casings 8 and valves 26 to discharge pipe 27 extending from each valve 26 and into the sump 7. Upon accumulation of a sufficient quantity of oil within the sump 7, the pump 31 may be activated to lift the oil through the collection line 9 to the separator tank 32 as hereinbefore stated.

It has been determined that the practices hereinbefore described will require at least one such installation for an area of approximately one million square feet, or approximately twenty-three acres, of the formation 4 of interest. Accordingly, and as more particularly depicted in FIG. 3, it will be seen that the present invention is more profitably employed by installing a plurality of such installations, and by operating such installations in a simultaneous manner, whereby the entire field can be drained in a systematic manner.

Referring now to FIGS. 4–6, there may be seen an illustration of various stages in the construction of the system hereinafter described. In particular, the shaft 3 is first drilled or excavated to an appropriate depth, and is thereafter lined with steel casing 20 as hereinbefore explained. However, the portion of the shaft extending across the formation 4 is preferably provided with sections of casing 20 which are bolted together, rather than being welded, and are further provided with appropriate holes for drilling six to ten-foot long grouting holes 10 into the formation. After the grouting holes 10 are completed, concrete is injected into the earth by an appropriate grouting machine (not depicted) which will be located within the bottom of the excavated shaft 3. After a concreted area 11 has been provided as suggested in FIGS. 5 and 6, the bolted steel casing may be removed, and the chamber 5 may then be constructed by excavation in a conventional manner.

Referring again to FIG. 3, it will be noted that the length of the radials 6 will depend upon their relative position to each other, since it is intended that the radials function to eject a steam mixture in a uniform manner throughout a substantial portion of the formation 4. Accordingly, it is assumed that the area to be covered by each shaft 3 will be approximately twenty-three acres in extent, four of the radials 6 will be approximately 490 feet long, and four of the radials 6 will be approximately 690 feet long.

The position of the radials 6 within the formation 4 will usually depend primarily upon the character of the substance sought to be recovered. If the mineral is high viscosity oil, then the radials 6 will usually be aligned along and adjacent the lower side of the formation 4, even if the formation 4 lies at an angle with respect to horizontal, since the internal pressure within the formation 4 will drive the oil through the radials 6 and into the shaft 3. If the mineral of interest is salt, sulfur, or a metallic ore or the like, it may be convenient to extend the radials 6 in a horizontal direction from the shaft 3, and even tilted upwardly at a small angle, to facilitate gravity flow therethrough.

The diameters of the radials 6 will depend primarily upon the type of matrix composing the formation 4, as well as upon the viscosity of the oil sought to be recovered therefrom. The steam mixture line 21 is preferably provided with insulation material such as asbestos, in order to minimize heat loss, and is preferably provided with a suitable expansion joint 19 adjacent its upper end, as depicted in FIG. 7.

Referring now to FIG. 9, there may be seen another simplified pictorial representation of an alternative embodiment of means suitable for practicing the present invention, wherein the central shaft 13 may be drilled from the surface of the earth 2 to and across the formation 4 of interest, and wherein arcing drill holes 18 which begin at locations spaced from the top of the shaft 3 extend down to and along the formation 4 towards the shaft 3. These arcing drill holes 18 may be used as steam mixture injection lines, in lieu of the line 21 depicted in FIG. 7, with the central shaft 3 receiving oil from radials 6 extending therefrom into the formation 4 as hereinbefore explained.

Although the present invention has been heretofore discussed and illustrated primarily with respect to alternate steam mixture injection and oil recovery through the central shaft 3, it will be apparent that conventionally completed production wells (not depicted) can be provided at appropriate locations relative to the shafts 3 depicted in FIG. 3. In such an arrangement, the steam mixture will then be injected through the line 21 into the formation 4 on a continuous basis, since oil can be recovered through these alternative production wells as hereinbefore explained.

As hereinbefore stated, it is within the concept of the present invention to inject a steam mixture and the like into one or more radials 6 extending from a particular shaft 3, while simultaneously receiving oil from one or more other radials 6 extending from the same shaft 3. Furthermore, this may be done for more than one shaft 3 at the same time, in order to more effectively sweep the formation 4 of interest. Referring again to FIG. 2, it will be seen that if the steam mixture is injected into radials 6A while radials 6B are opened to drain oil into the sump 7, the injected steam mixture will tend to drive the oil into the collection points at the same time it heats the oil adjacent the shaft 3, and thus, the area about the shaft 3 will be more effectively swept with steam and inert gas and drained of oil. Referring now to FIG. 3, it may be seen that the rectangular pattern of the various groups of radials 6A–B will permit this technique to operate effectively with respect to larger areas of the field.

The present method of this invention contemplates avoiding the aforementioned disadvantages of the prior art by incorporating two modifications to the methods and apparatus presently disclosed and claimed in the aforementioned Turk et al patent application, U.S. Ser. No. 766,523, filed Feb. 7, 1977. In the first place, the present invention proposes to establish the steam injection rate at a magnitude which is not limited by a "critical velocity" within the particular formation of interest. More particularly, however, the present invention proposes to employ a mixture of steam and "stack gas" (inert gases), in lieu of the conventional pure steam which is normally injected into the formation as a part of conventional steam injection techniques.

As used herein, the term "inert gas" shall mean any gas which is both noncondensable in character at ambient formation temperatures and which does not interact with either the formation matrix or the oil or other earth materials contained therein. Accordingly, the term "inert gas" will include not only gases such as helium, methane, air, carbon dioxide, anhydrous ammonia, nitrogen, but also flue and stack gas and other combustion products from internal combustion engines, steady state burners, and the like.

There are basically two reasons for the use of an injection mixture of steam and inert gases. It is well known that steam at ambient pressure depends upon being maintained at a temperature greater than 212° F. in order to maintain its gaseous character, and that when the temperature drops below this level, the steam will suddenly condense into the liquid. During steam injection operations, the steam will necessarily eventually decline in temperature to a level whereupon the condensation of the steam within the formation will produce a distinct pressure drop which is inconsistent with the purposes of the operation. In fact, it may even produce a relative vacuum within the formation which will actually suck the oil away from the borehole, rather than pushing it towards the borehole. If a mixture of steam and inert gas is used, instead of pure steam used in conventional operations, then the inert gas will not be lost upon condensation of the steam, but will continue to travel through the formation to exercise a continued heating and driving effect upon the oil trapped therein.

An injection fluid which is composed entirely of inert gases avoids the disadvantageous effect of condensation within the formation since the inert gas will remain in the gaseous state. Inert gases, however, have a severely restricted specific heat in contrast with steam, and therefore will not carry nearly the same amount of heat into the formation as can be achieved with steam.

A further feature of the use of a mixture of steam and inert gas is that such a mixture will migrate and disperse through the formation to a much greater extent than will an injection of pure steam. This is due to the fact that the inert gas has a relatively higher diffusivity than is the case with steam.

And another important feature of the subject invention is that the inert gas will not only remain gaseous when the temperature of the mixture drops below the boiling point of water, but will migrate upward to the top of the formation to either create or enhance the gas cap within the formation. Accordingly, as repeated injection cycles are performed, the oil is not only reduced in viscosity, but the gas cap in the formation tends to be increased to the point where it will make a significant contribution to the driving forces within the formation.

It will be apparent that when the process disclosed in the Turk et al application is used, there is no contribution to the gas cap after the steam has condensed and the only driving force to be exerted upon the oil will be the force of gravity. If the Turk et al process is modified as proposed herein, however, not only will the forces of gravity still be present to deliver the oil to the same extent as may be expected with the Turk et al process, but it may also anticipate an addition to the driving forces as contributed by the buildup of an inert gas cap in the formation. Furthermore, since the laterals may be located at the bottom of the formation as taught by Turk et al, this gas cap should not be dissipated upon production of the oil, but should remain in place so as to continue to exercise the driving force sought for.

Although much has heretofore been said regarding the "critical velocity" of an operation, it should be noted that although this is a particular aspect of conventional vertical well steam injection operations and although it would also be true if conventional vertical well injection operations were conducted with a mixture of steam and inert gas, the same is not true if the present process is practiced with a mixture of steam and inert gas. The reason for this is that a critical velocity for this operation does not exist when you are seeking vertical penetration of the formation by the injected mixture, at least as that term is used with respect to conventional steam injection operations.

In the present operation, it will be noted that the laterals may be located substantially along the lower portion of the formation, and that it is expected that the injected mixture of steam and inert gas will merely rise through the formation rather than traveling laterally therefrom. In this event, velocity is not a particular factor, and therefore the steam and inert gas mixture may be injected at substantially any particular rate found to be desirable as a function of other operating parameters of the system. More specifically, in the present invention it is possible to inject the steam and inert gas mixture into the formation at high rates, which is not possible with conventional vertical well steam injection operations, and is not even possible in conventional vertical well operations wherein the injected fluid is a mixture of steam and inert gas.

It should be noted that, no matter what the character of the injected mixture may be, the overall volumetric sweep efficiency will be greater with the use of a technique such as described in the instant application, than it will be with respect to conventional vertical well injection procedures. The reasons for this superiority are that the use of the present technique will permit the steam and inert gas mixture to be injected at many points in the formation, as contrasted with only a few injection points as is the case with conventional vertical well steam injection techniques.

When the present technique is used, the injected fluid is expected to rise vertically through the formation, rather than to move horizontally through the formation as in the case of conventional vertical well injection techniques. Since the injected mixture of steam and inert gas is of a lower density than the oil sought to be treated, the injected mixture will naturally rise through the formation in a vertical direction. Accordingly, the use of the present technique tends to be an advantage over conventional techniques, since it intends to employ a phenomenon which is an undesirable characteristic of conventional vertical well injection techniques. In other words, the present method contemplates that which will occur naturally, i.e., that the injected mixture of steam and inert gas rise through the formation vertically whereas this is an undesirable characteristic of conventional vertical well techniques.

The ideal location of the laterals is usually adjacent the lower level of the formation. However, it may be advantageous in some circumstances to employ a plurality of radials extending from the subsurface chamber at various preselected vertical levels in some formations, as for example at the lower and mid-point vertical levels. The reason for this alternative arrangement is that it will take advantage of lithological differences occurring at different vertical elevations within the formation, and in particular to allow for the existence of lenses and other types of anomalies.

It should be noted that there is a novel feature in the proportion of inert gas to the quantity of steam being employed as the injection mixture. In particular, the mixture may appropriately be composed of approximately 100–600 cubic feet of gas to each barrel of water converted to steam at an 80% quality. In other words, the ideal mixture would be approximately 300 cubic feet of inert gas for each barrel of water converted into steam. It should be noted, of course, that the particular percentages may vary depending upon the type of inert gas employed, and the foregoing figures are those contemplated to be used when the inert gas is flue or "stack" gas.

As hereinbefore described, the techniques of the present invention are inferentially directed to recovery of relatively heavy oils. However, it should be noted that these techniques are not limited to heavy oils only, but can be used with substantial effect in recovering hydrocarbons of various weights and gravities.

In addition, it will be noted that the discussions hereinbefore set forth have inferrentially contemplated recovery of these hydrocarbons in primarily liquid form, whereas a suitable "soak" stage will effectively create a temperature in the formation wherein medium (35 API and the like) and high (45 API and the like) gravity oils will be effectively vaporized in the formation. Accordingly, it may be convenient for the purposes of the present invention to employ standard technology for handling and saving such vaporized hydrocarbons, as well as to recover the liquids sought to be saved. Furthermore, it should be noted that this vaporizing capability has particular applicability to situations wherein recovery is limited, not by reason of any defect with respect to the oil, but because of limited permeability of the formation matrix.

The foregoing discussions of the present invention have also been directed at least primarily to processes wherein recovery of oil, from the heated formation, is effectively the terminal stage of the procedure, whereas this is not necessarily always the case. It should be recognized that, since the primary driving mechanism is the formation pressure, and since formation pressures will inherently decline with recovery of the oil, it may often be desirable if not necessary to periodically reinforce the formation pressure.

It is well established that formation pressure tends to follow a predictable pattern of decline as oil is recovered from the formation. Furthermore, in conventional installations and especially when production is had through a vertical drill hole, the rate at which oil is recovered also tends to follow a predictable decline pattern which corresponds at least functionally with the decline pattern of the formation pressure. In an installation of the type herein contemplated, however, where the formation is tapped by drill holes positioned laterally within the formation, a distinct anomally has been noted with respect to the decline pattern of the rate at which oil is recovered from a formation of interest.

In particular, it has been noted that although formation pressure tends to follow a conventional decline pattern, from its initial peak level to the level at which oil production ceases, the rate at which oil is recovered tends to follow an expected decline pattern only during the upper and lower portions of the range between peak and zero, and that there is an intermediate portion of the pattern wherein the rate of production decline exhibits an anomally. More specifically, the production rate tends to decline in a predictably precipitous manner until the formation pressure decline reaches a first "intermediate" level. Thereafter, however, the rate of production decline gradually slackens and becomes increasingly less precipitous as the formation pressure further declines to a distinct second "intermediate" pressure level. This second "intermediate" pressure level will usually appear relatively substantially below the first "intermediate" level, but will nevertheless be still well above the lowest pressure level at which production can still be achieved from the formation.

Once the formation pressure declines below this second lower "intermediate" level, the rate at which production declines will again become relatively precipitous as would be expected. Accordingly, it is only during this pressure range between these two "intermediate" pressure levels, that the rate at which production declines is not as expected. However, it is this anomally in the decline pattern of the recovery rate of the installation which provides an opportunity to not only maximize recovery from the formation of interest, but also to more efficiently produce the oil with respect to operating costs.

In particular, this can be done by first injecting steam or the like into the formation, as hereinbefore explained, and by thereafter injecting a pressurizing fluid composed at least substantially of a non-condensible gas into the formation, also as hereinbefore described. Thereafter, and after the formation pressure has been permitted to stabilize at its "peak" pressure level, the formation is opened to permit recovery of oil from the lateral drill holes. However, production is continued only so long as the pressure drop approaches but does not exceed this second "intermediate" pressure level at which the anomally in the decline pattern of the production rate will manifest itself. At or about that point, the formation is again preferably shut in, and the step of injecting a pressurizing gas into the formation is repeated to restore the formation pressure to a level which is preferably above the original "peak" level, and which is at least substantially above the first higher "intermediate" level, before production is resumed.

It should be especially noted that the formation pressure declines in an expected manner throughout the entire range between the peak level and the level at which production ceases, and it is only the rate of production from the formation which manifests this anomally in its decline pattern, and then substantially only within the range between the first and second "intermediate" levels as hereinbefore explained. On the other hand, it will thus be apparent that during this range, and especially at those levels wherein the decline in formation pressure approaches but does not go below the lower second "intermediate" pressure level, the rate of decline of oil recovery is clearly less than the rate at which the formation pressure is declining. Thus, there is a clear advantage in producing the formation only during the pressure range wherein the formation pressure approaches but does not go below this second "intermediate" level.

The particular values of the so-called "peak" and "intermediate" pressure levels will, of course, depend upon circumstances and conditions which are peculiar to each installation, and therefore these levels will necessarily be required to be determined in order to best employ the procedures and technology of the present invention in each particular case. On the other hand, determining a pressure level with respect to the production rate of a formation can be performed with conventional techniques, and therefore these values can be readily determined by any operator of reasonable skill using only empirical methods, without departing from the essential concepts of the present invention.

The exact explanation for the foregoing anomally which is exhibited is not clearly understood with certainty, inasmuch as the anomally may be due in part to more than one reason. In particular, however, it will be noted that during the initial steam injection stage or cycle, much of the steam will tend to be condensed in the formation due to the high build-up in formation pressure, as well as because of heat transfer into the oil contained therein. For example, the eventual "peak" pressure may, in an ideal arrangement, be as high as approximately 500 PSIG or higher.

It should be remembered that, in this type of installation, the formation is tapped by a plurality of lateral boreholes each being many times longer than the portion of a vertical drill hole which actually traverses the formation in a conventional system, and that each of these lateral drill holes contains a length of multi-perforated tubing. Thus, when the formation is initially opened for purposes of recovering oil therefrom, there is a much higher immediate rate of fluid discharge from the formation than is the case with a conventional installation with a single vertical borehole. More particularly, this immediate or abrupt pressure drop, together with the high temperature in the formation, causes the water adjacent the laterals to "flash" into steam.

Some of this steam will, of course, tend to discharge into the laterals. However, a substantial quantity of this steam passes instead into and upward through the oil in the formation, to contribute to the gap sought to be created above the laterals. When this is achieved, the steam then contributes to driving the oil down to and into the laterals at an unexpectedly greater rate than is expected with relationship to the exhibited pressure decline rate (since there are more perforations in the several laterals than in the perforated portion of a vertical well casing.)

This abnormally high production rate does not continue unabated, as hereinbefore stated, but commences a more precipitous decline when the formation pressure reaches the second "intermediate" level. This, however, is due to several reasons.

In the first place, the aforementioned "flash" tends to produce only a localized effect in the portion of the formation defined by the laterals, and thus the pressurizing effect of this "flash" will inherently be limited in duration. In the second place, the temperature build-up which has been created in the formation is also localized, and especially with respect to the oil which has been reduced in viscosity. Accordingly, when this heated and therefore more moveable oil has been driven into the laterals, this has also removed a substantial amount of heat from the formation, and re-injection of steam will be required before production can be resumed at the more advantageous rate.

The particular levels of the aforementioned first and second "intermediate" pressure levels will, of course, not necessarily be the same for each production cycle, although it can be anticipated that such levels will continue to be apparent. Furthermore, it may be reasonably expected that the same levels will be encountered at adjacent locations in the same formation during corresponding cycles of this process.

Other alternate forms of the present invention will suggest themselves from a consideration of the apparatus and practices hereinbefore discussed. Accordingly, it should be clearly understood that the systems and techniques depicted in the accompanying drawings, and described in the foregoing explanation, are intended as exemplary embodiments of the invention, and not as limitations thereto.

What is claimed is:

1. A method of recovering oil and the like from a subsurface earth formation, comprising the steps of:

establishing a shaft hole extending from the surface of the earth to said subsurface earth formation;

drilling a plurality of boreholes substantially laterally from said shaft hole into said subsurface earth formation;

injecting a heating fluid comprising substantially steam into said boreholes during a first discrete time interval for transferring heat to said oil in said formation, thereafter injecting a pressurizing fluid comprising substantially an inert gas into said boreholes during a second discrete interval for exerting a downward pressure on said oil in said formation, and withdrawing oil from said boreholes in response to said downward pressure exerted in said formation during a third time interval following said first and second time intervals.

2. The method described in claim 1, wherein said boreholes are located adjacent the lower limit of said formation.

3. The method described in claim 1 or 2, further including:

sealing and maintaining said injected pressurizing fluid within said formation during an intermediate time interval between said second and third time intervals.

4. The method described in claim 3, wherein said plurality of boreholes lie within a substantially horizontal plane within said subsurface earth formation.

5. A method of recovering oil and the like from a subsurface earth formation, comprising drilling at least one borehole substantially laterally into said earth formation, thereafter injecting into said formation through said borehole a heating fluid composed at least substantially of steam, thereafter injecting a pressurizing fluid through said borehole and into said formation to stabilize the pressure in said formation at a determinable peak level, thereafter withdrawing oil from said borehole until the pressure in said formation declines below a first higher intermediate level and approaches but does not go below a second lower intermediate level, and thereafter re-injecting said pressurizing fluid through said borehole and into said formation until the pressure therein rises above said first intermediate level.

6. The method described in claim 5, including the step of thereafter again withdrawing oil from said borehole until the pressure in said formation again approaches but does not go below said second lower intermediate pressure level, and thereafter again re-injecting said pressurizing fluid into said formation until said pressure therein again rises above said first intermediate level.

7. The method described in claim 6, wherein said heating fluid comprises a preselected mixture of steam and a non-condensible gas.

8. The method described in claim 6, wherein said pressurizing fluid is composed at least substantially of a non-condensible gas.

9. The method described in claim 6, wherein said heating fluid comprises a preselected mixture of steam and an organic solvent.

* * * * *